United States Patent [19]

Wiegand et al.

[11] Patent Number: 4,828,115

[45] Date of Patent: May 9, 1989

[54] CONTAINER FOR UNASSEMBLED COMPONENTS OF CONSUMER ITEM

[75] Inventors: Charles F. Wiegand, Florissant; Terrence L. Stanek, St. Louis, both of Mo.

[73] Assignee: Emerson Electric Co., St. Louis, Mo.

[21] Appl. No.: 18,748

[22] Filed: Mar. 3, 1987

Related U.S. Application Data

[63] Continuation of Ser. No. 784,820, Oct. 4, 1985, abandoned.

[51] Int. Cl.[4] ..... B65D 69/00

[52] U.S. Cl. ..... 206/576; 206/319; 206/320; 206/523; 206/590; 206/577

[58] Field of Search ..... 206/319, 320, 523, 524, 206/576, 590, 585, 587, 588, 589, 592, 577; 220/23.4

[56] References Cited

U.S. PATENT DOCUMENTS

| | | | |
|---|---|---|---|
| 1,913,649 | 6/1933 | White | 206/577 |
| 2,281,923 | 5/1942 | Davis | 206/576 |
| 2,491,680 | 12/1949 | Meyerhoefer | 206/320 |
| 2,543,258 | 7/1958 | Boeye | 206/319 |
| 2,971,640 | 2/1961 | Snelling | 206/524 |
| 3,088,584 | 5/1963 | Kozikowski | 206/587 |
| 3,103,278 | 9/1963 | Kuzma et al. | 206/585 |
| 3,243,037 | 3/1966 | Luertzing | 206/592 |
| 3,311,231 | 3/1967 | English, Jr. | 206/523 |
| 3,366,231 | 1/1968 | Trakas | 206/320 |
| 3,414,121 | 12/1968 | Suzuki | 206/320 |
| 3,467,245 | 9/1969 | Kawawada | 206/523 |
| 4,166,531 | 9/1979 | Fujiwara | 206/320 |
| 4,173,286 | 11/1979 | Stanko | 206/589 |
| 4,174,036 | 11/1979 | Beckman et al. | 206/319 |
| 4,234,092 | 11/1980 | Axel | 206/523 |
| 4,254,866 | 3/1981 | Fales et al. | 206/588 |
| 4,522,303 | 6/1985 | Starr | 206/592 |
| 4,566,588 | 1/1986 | Kataczynski | 206/523 |
| 4,640,419 | 2/1987 | Yang | 206/577 |

FOREIGN PATENT DOCUMENTS

| | | | |
|---|---|---|---|
| 2938552 | 4/1981 | Fed. Rep. of Germany | 206/320 |
| 52786 | 4/1977 | Japan | 206/576 |
| 1103584 | 2/1968 | United Kingdom | 206/523 |

*Primary Examiner*—Stephen Marcus

*Attorney, Agent, or Firm*—Polster, Polster and Lucchesi

[57] ABSTRACT

A container for the components of an unassembled ceiling fan includes a first casing of expanded polystyrene foam. The first casing includes at least one internal recess shaped to receive a first component of the ceiling fan to protect it from damage during shipping. A second casing of expanded polystyrene foam includes at least one internal recess shaped to receive at least a second component of the ceiling fan to protect it from damage during shipping. The first and second casings have comparable cross-sectional areas and include structure integral therewith for interlocking the casings to restrict relative movement of the casings. At least the first casing provides sufficient protection to its contents to protect them from damage when the first casing is shipped without the second casing. A box or the like of suitable size receives the first and second interlocked casings to form a package.

1 Claim, 5 Drawing Sheets

CONTAINER FOR UNASSEMBLED COMPONENTS OF CONSUMER ITEM

This is a continuation application of copending application Ser. No. 784,820, filed on Oct. 4, 1985, now abandoned.

BACKGROUND OF THE INVENTION

This invention relates to packaging and containers and more particularly to composite containers for unassembled components of a consumer item such as a ceiling fan.

The manufacture of many products, such as ceiling fans, often involves obtaining numerous components of the product (such as housings, the fan motor, fan blades, etc.) from various locations across the country or around the world and assembling them into the final product. Many times this requires the unpackaging of components shipped to one destination and the repacking of those components, along with other components, in either an assembled or unassembled form to another destination. Unpacking and repacking is time-consuming and labor intensive and, unless assembly is also accomplished, adds little or no value to the final product. In addition, the components can become damaged during this process. Simply shipping the components separately to the final destination is not necessarily a solution, however, since the size of the separate containers may very well exceed the size of one container in which the various components are repacked. Moreover, separate containers can become lost in shipment with the result that the buyer may not receive all the components necessary to assemble the final product. It is also undesirable to ship smaller components separately from larger components, even from the same location because of this risk of loss. All components from a single location can, of course, be shipped together by packing them in a larger container, but this usually increases shipping costs.

SUMMARY OF THE INVENTION

Among the several objects and features of the present invention is the provision of a container system which reduces or eliminates the need to unpack and repack components received from different locations.

Another object of the present invention is to minimize the size of the packages of unassembled components being shipped.

An additional object of the present invention is to provide a single container for the various components of a consumer item.

A further object of the present invention is to provide a container which utilizes the existing packaging of certain components without the necessity of unpacking those components.

Another object of the present invention is the provision of a container system which is relatively economical and provides adequate protection for its contents.

Other objects and features will be in part apparent and in part pointed out hereinafter.

Briefly, the container of the present invention includes a first casing of packaging material, which casing includes at least one internal recess shaped to receive at least a first component of a consumer item such as a ceiling fan or the like to protect it from damage during shipping. A second casing of packaging material includes at least one internal recess shaped to receive at least a second component of the consumer item to protect it from damage during shipping. The second casing has a cross-sectional area generally the same as the cross-sectional area of the first casing. The first and second casings each include means integral therewith for interlocking the casings to restrict relative movement of the casings. At least the first casing provides sufficient protection to its contents to protect them from damage when the first casing is shipped without the second casing. A box or the like of suitable size is provided to receive the first and second interlocked casings to form a package.

BRIEF DESCRIPTION OF THE DRAWINGS

Similar reference characters indicate similar parts throughout the several views of the drawings.

DESCRIPTION OF THE PREFERRED EMBODIMENT

Figure 1:
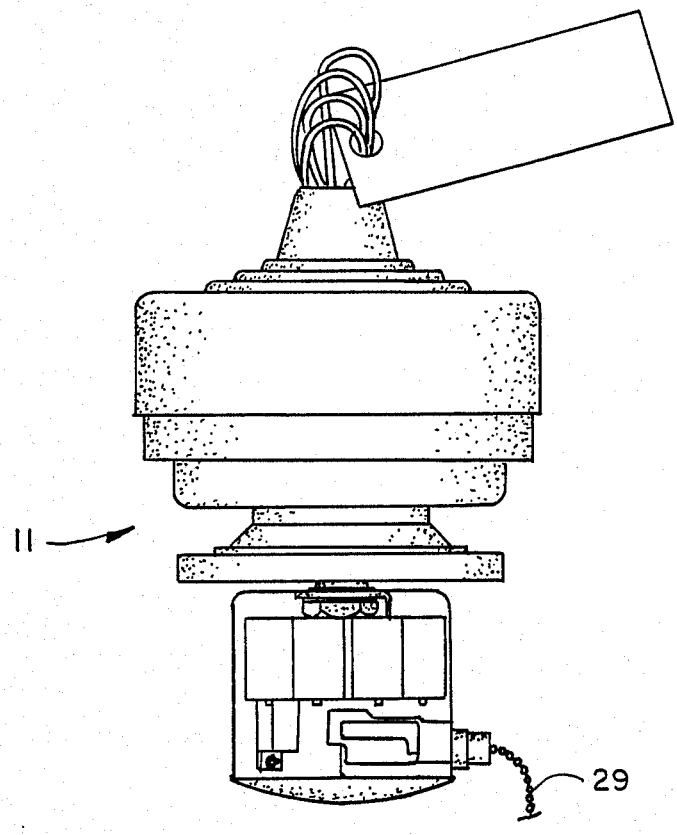
FIG. 1 is a front elevation of a component of a ceiling fan to be packed using the container of the present invention.

Referring now to the drawings, a component, namely a motor and switch assembly 11 (FIG. 1), of a ceiling fan is shown prior to being packed in the container of the preset invention. A completed ceiling fan also includes a housing 13 (FIG. 7) for the motor, flanges 15 (FIG. 7) for mounting fan blades 17 (FIG. 8) to assembly 11, a pipe 18 for extending upwardly from assembly 11 to a hanger bracket 19 (FIG. 7) holding a ball assembly 21.

Figure 2:
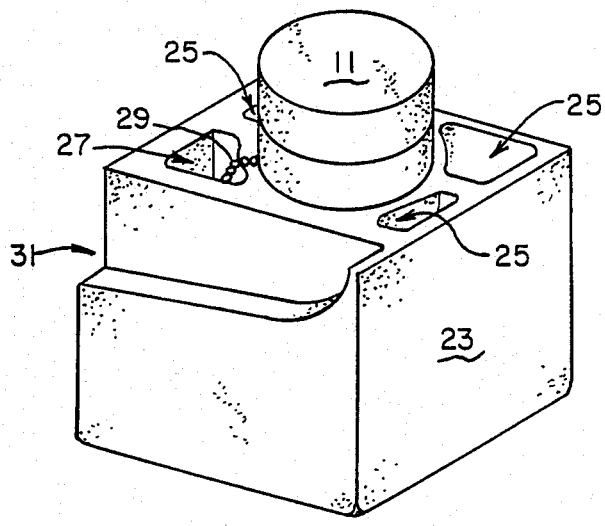
FIG. 2 is a simplified perspective of a portion of the container of the present invention with the component of FIG. 1 cradled therein.

Assembly 11 sits in a mating recess in an expanded polystyrene foam casing for shipment, the lower half of which is labelled 23 in FIG. 2. Casing half 23 includes numerous internal recesses 25 which serve to reduce the weight of the casing and expedite the molding of the casing half, and an internal recess 27 suitably placed to isolate the pull chain 29 of assembly 11 from the body of the assembly to keep the chain and body from striking each other during shipment (which might scratch or mar the finish of the assembly). A recess 31 formed in the exterior surface of casing half 23 when the container of the present invention is fully assembled provides a place for holding fan blades 17 separate from the other components of the ceiling fan.

Figure 3:
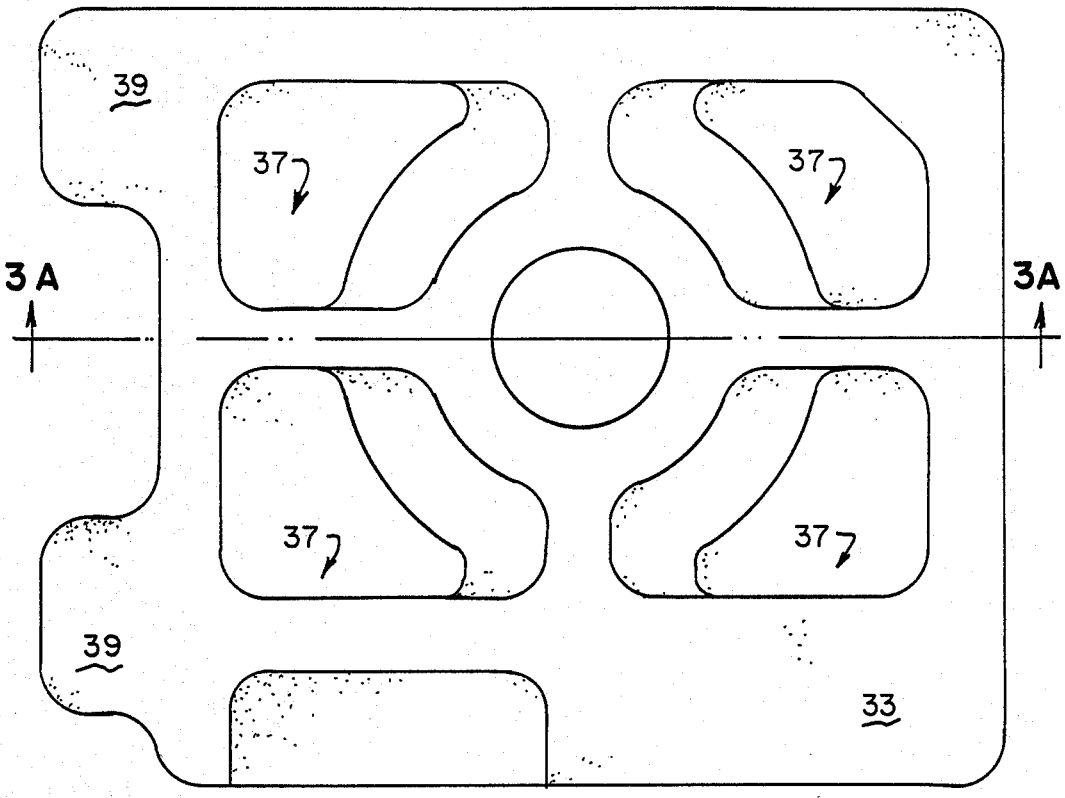
FIG. 3 is a top plan of a second portion of the container of the present invention which rests upon the portion shown in FIG. 2.
Figure 3A:
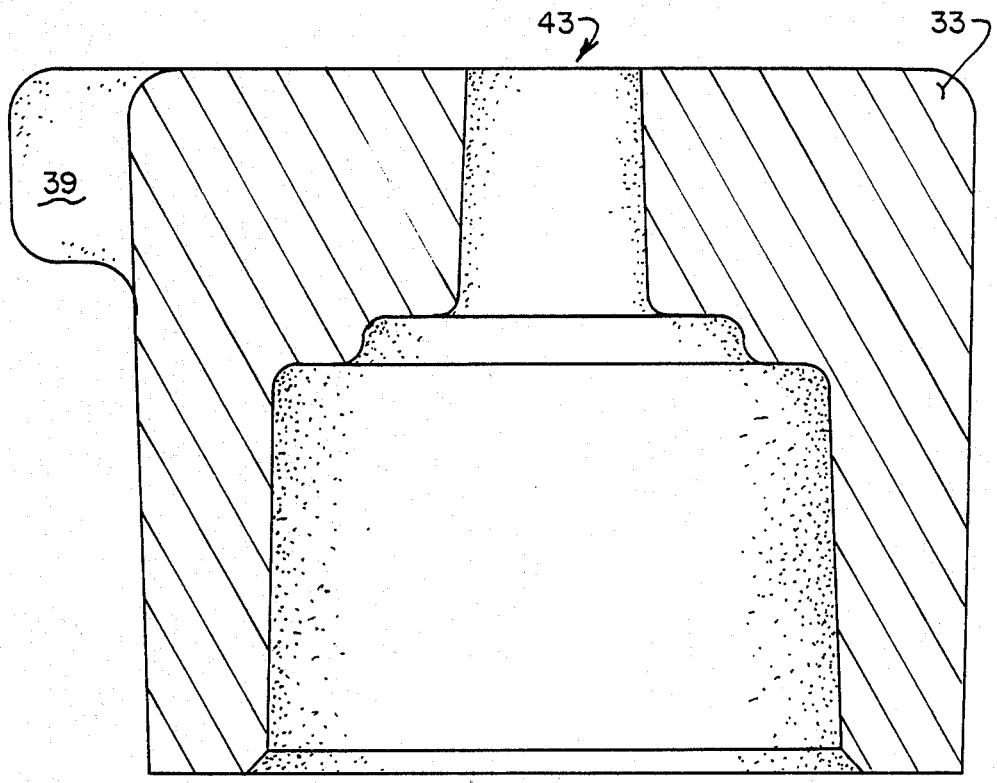
FIG. 3A is a cross sectional view taken along line A—A of FIG. 3.
Figure 8:
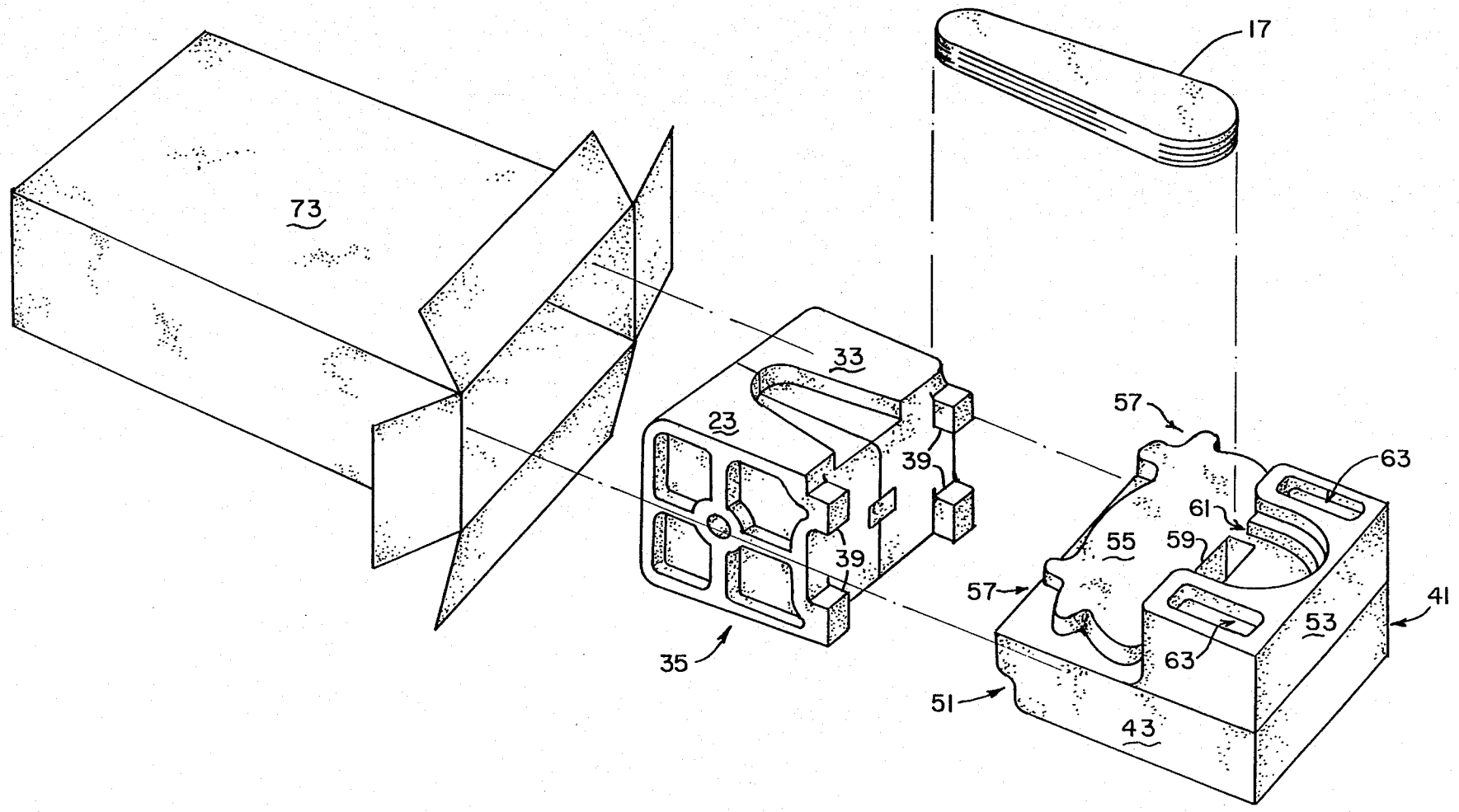
FIG. 8 is an exploded view of the container of the present invention.

A second casing half 33 (FIGS. 3 and 3A) of expanded polystyrene foam is dimensioned to fit over assembly 11 and mate with casing half 23 to form a protective casing 35 (FIG. 8) around motor and switch assembly 11. Casing half 33, like casing half 23, includes internal recesses 37 to reduce the weight of the casing and expedite the molding of same. This casing half also has formed integrally therewith two posts 39 (casing half 23 also has such posts—see FIG. 8) which constitute means for interlocking casing 35 with a similar casing 41 (FIG. 8) for housing 13 and its associated components. Casing half 33 also has a internal central recess 43 (FIG. 3A) sized to hold the upper half of assembly 11 during shipping. Once assembled together to form casing 35, casing halves 23 and 33 are taped together as shown in FIG. 8 to form a single casing around assembly 11.

Figure 4:
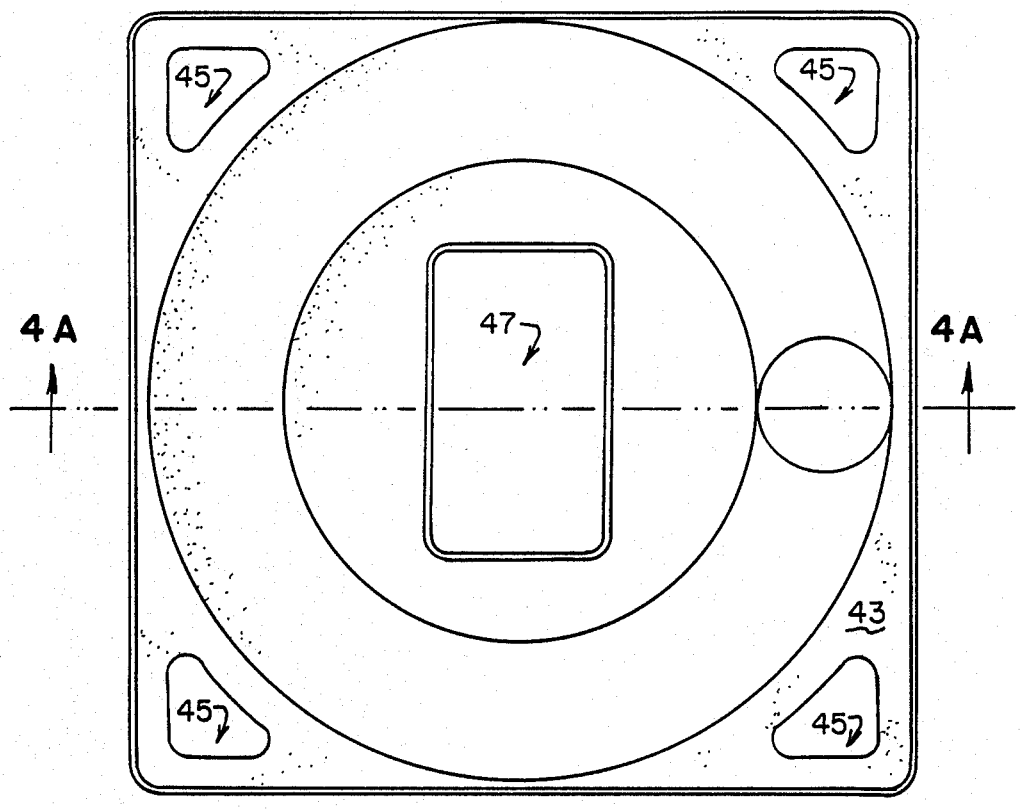
FIG. 4 is a bottom plan of a third portion of the container of this invention.
Figure 4A:
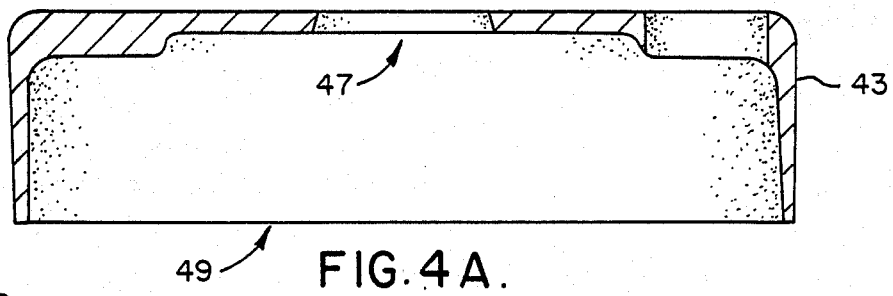
FIG. 4A is a cross sectional view taken along line A—A of FIG. 4.

Like casing 35 for the motor and switch assembly, casing 41 for the housing and associated parts is formed from two halves. The bottom half 43 (FIGS. 4 and 4A) has a generally flat bottom with internal recesses 45 at the corners and a generally rectangular internal recess 47 in the center. The interior of casing half 43 is hollowed out (see FIG. 4A) to receive housing 13 of the ceiling fan, the opening thus formed being labelled 49. The exact shape of opening 49 is of course chosen to correspond to the exterior shape of housing 13. Casing half 43 also has formed integrally therewith a pair of cut-outs or hollows 51 in two of the corners (see FIG. 8 for one of the cut-outs) for interlocking with posts 39 of assembly casing 35.

Figure 5:
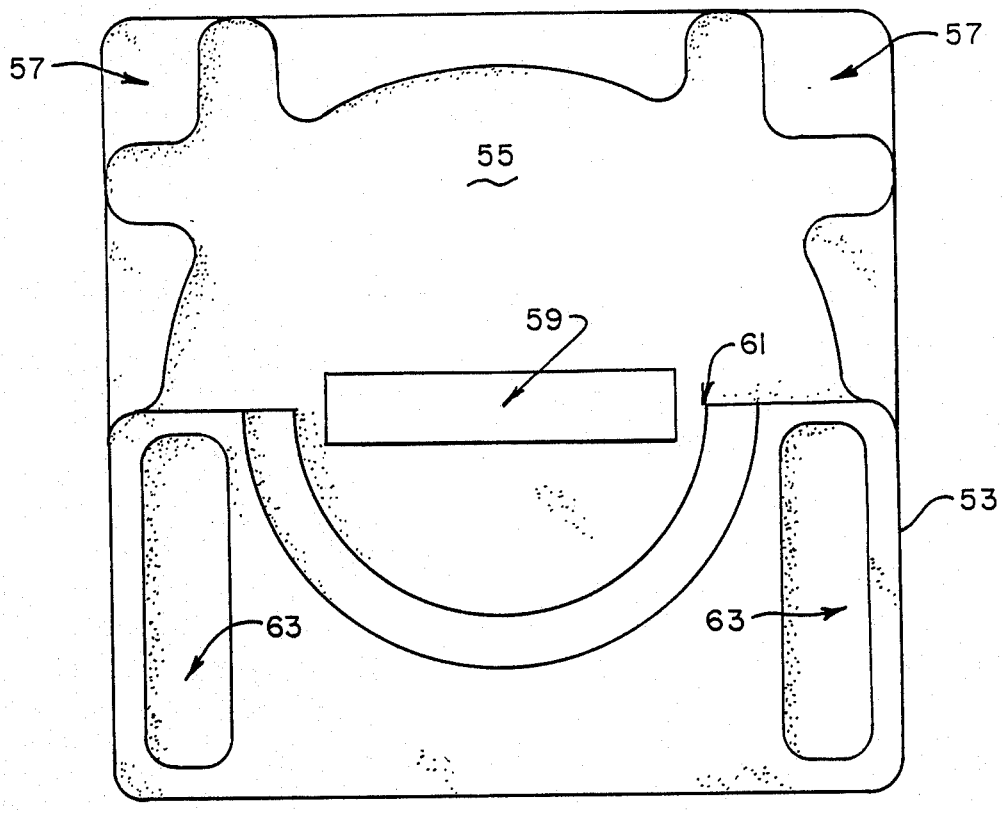
FIG. 5 is a top plan of a fourth portion of the container of the present invention which rests upon the portion shown in FIG. 4.

The other half of casing 41 is formed by casing half 53 (FIG. 5). Instead of cut-outs 51 for interlocking with posts 39, casing half 53 has an integrally formed, irregular surface 55 which defines two notches or hollows 57, one at each corner, which provide the interlocking with casing 35. Casing half 53 also includes a central recess 59, and a stepped notch 61 for supporting the fan blades. Adjacent stepped notch 61 are a pair of internal recesses 63.

Figure 6:
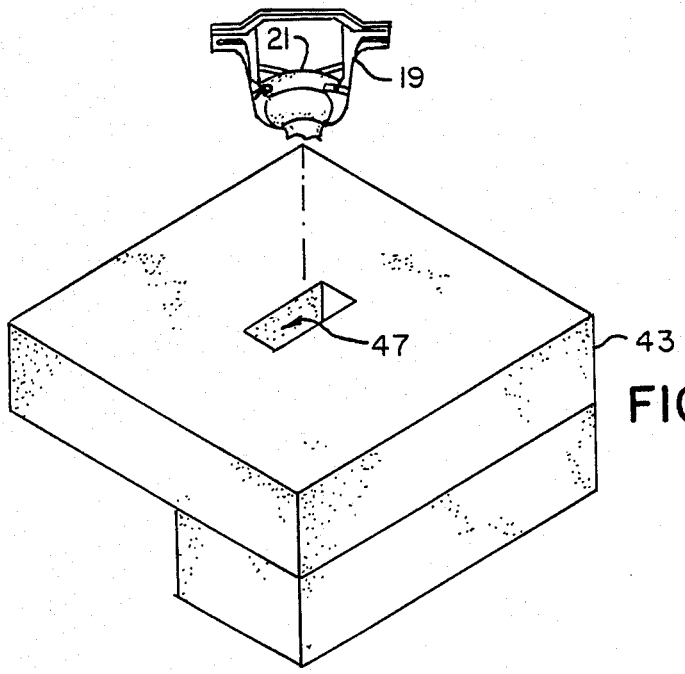
FIG. 6 is a perspective view of the bottom of the portion shown in FIG. 4 illustrating one feature of this invention.

Rectangular recess 47 in the bottom of housing casing half 43 is provided so that (see FIG. 6) hanger bracket 19 and ball assembly 21 may be inserted into casing 41 after the casing is assembled around the housing without disturbing the contents of the casing. This is accomplished by pushing the bracket and ball assembly into recess 47 and then rotating the bracket ninety degrees to cause the flanges 65 on the bracket to be held securely by the resilient foam casing.

Figure 7:
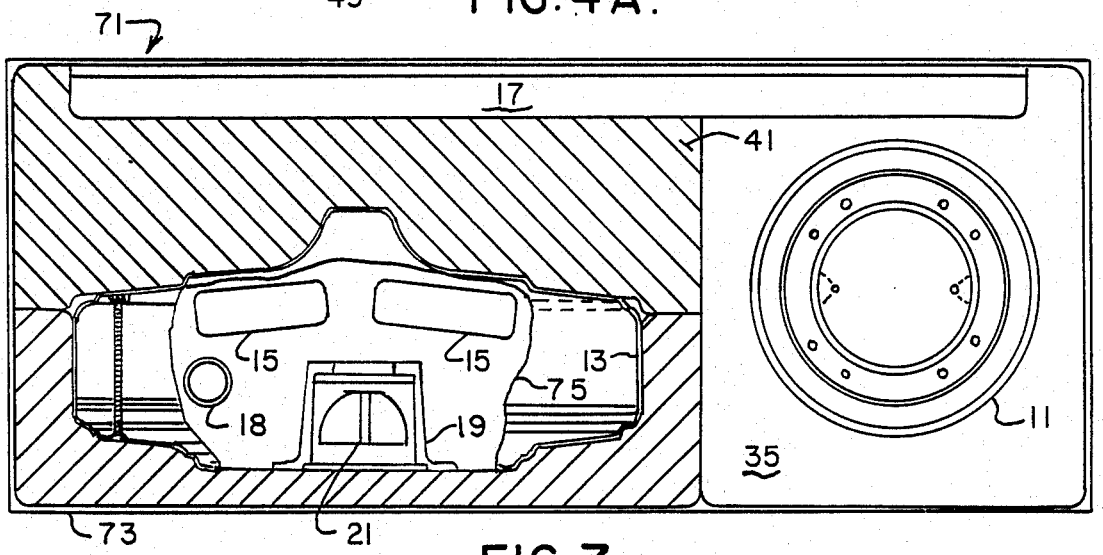
FIG. 7 is a simplified packing diagram illustrating the construction of the assembled container of the present invention.

The physical placement of casings 35 and 41 is shown in simplified form in FIG. 7. Housing 13 is disposed in casing 41 with its longitudinal axis pointing upwardly as seen in the figure. Motor and switch assembly 11, on the other hand, is disposed with its longitudinal axis going into the paper as shown in the figure. That is, the longitudinal axes of the housing and the assembly are disposed at right angles to each other for shipping. This configuration minimizes the size of the resulting container 71, which comprises not only casings 35 and 41, but also a box 73 in which the casings are placed. This configuration is needed because the width of housing 13 is much greater than the width of assembly 11 and in fact is comparable to the height of the assembly.

Space is also minimized by utilizing the space inside housing 13. A bag 75 of suitable plastic material is positioned inside housing 13 and filled with other small components that originate from the same general location as the housing. These components include flanges 15 and pipe 18, for example. Casing 41 is then closed around the filled housing and is shipped to the point at which the two casings are joined together. Casing 41 is designed so that housing 13 and its contents are protected even if shipped by itself overseas. Casing 41 is received in the form shown in FIG. 8. Then bracket 19 and ball assembly 21 are inserted into casing 41 as described above without disturbing the contents of that casing. Casing 35, containing motor and switch assembly 11, is then interlocked with casing 41 by means of posts 39, recesses 51 and notches 57 to restrict shifting or relative movement of the two casings. Once so assembled a recess formed in the combined top surfaces of the casings receives the fan blades and the combination is inserted into box 73, ready for shipment to its destination.

From the above it will be seen that the container of the present invention eliminates the need to unpack and repack the housing casing and minimizes the size of the resulting package.

As various changes could be made in the above constructions without departing from the scope of the invention, it is intended that all matter contained in the above description or shown in the accompanying drawings shall be interpreted as illustrative and not in a limiting sense.

What is claimed is:

1. A container for the components of an unassembled consumer item such as a ceiling fan or the like comprising:

a first casing of packaging material, said casing including two casing halves of a shock absorbing, resilient cushioning material, the walls of said casing halves defining at least one internal closed recess shaped to receive and hold at least a first component of the consumer item to protect it from damage during shipping in commerce;

a second casing of shock absorbing, resilient packaging material, said second casing including at least one internal recess shaped to receive at least a second, different component of the consumer item to protect it from damage during shipping in commerce, the second casing having a cross-sectional area generally the same as the cross-sectional area of the first casing;

said first and second casings each including means integral therewith for interlocking said casings to restrict relative movement of the casings;

at least said first casing having walls sufficiently thick to provide protection to its contents to protect them from damage when the first casing is shipped in commerce without the second casing; and a box or the like of suitable size to receive the first and second interlocked casings to form a package;

wherein the first and second casings have aligned recesses defined in their non-confronting exterior surfaces suitable for holding a third component such as a fan blade, said aligned recesses being positioned such that they form a continuous recess when the first and second casings are interlocked, said continuous recess having a size to accept said third component.

* * * * *